US005859383A

United States Patent [19]

Davison et al.

[11] Patent Number: 5,859,383

[45] Date of Patent: Jan. 12, 1999

[54] ELECTRICALLY ACTIVATED, METAL-FUELED EXPLOSIVE DEVICE

[76] Inventors: David K. Davison, 6716 Galway Dr., Edina, Minn. 55439; Richard F. Johnson, 2716 Lamplighter La., Crystal, Minn. 55422

[21] Appl. No.: 717,197

[22] Filed: Sep. 18, 1996

[51] Int. Cl.[6] ..... F42B 1/02

[52] U.S. Cl. ..... 102/307; 102/308; 102/476

[58] Field of Search ..... 102/306–310, 102/476

[56] References Cited

U.S. PATENT DOCUMENTS

| | | | |
|---|---|---|---|
| 3,621,916 | 11/1971 | Smith, Jr. | 166/297 |
| 4,034,673 | 7/1977 | Schneider, Jr. | 102/56 SC |
| 4,080,898 | 3/1978 | Gieske | 102/56 SC |
| 4,216,721 | 8/1980 | Marziano et al. | 102/90 |
| 4,430,939 | 2/1984 | Harrold | 102/307 |
| 4,643,097 | 2/1987 | Chawla et al. | 102/306 |
| 4,766,813 | 8/1988 | Winter et al. | 102/307 |
| 5,090,324 | 2/1992 | Bocker et al. | 102/307 |
| 5,119,729 | 6/1992 | Nguyen | 102/307 |
| 5,155,296 | 10/1992 | Michaluk | 102/476 |
| 5,479,860 | 1/1996 | Ellis | 102/313 |
| 5,551,346 | 9/1996 | Walters et al. | 102/476 |

OTHER PUBLICATIONS

"Secondary Explosive Initiators and Accessories", Technical paper; Reynolds Industries Systems, Inc., pp. 1–8 and 17.

Austin, C.F., "Use of Shaped Charges in Mining", *Mining Congress Journal*, 56–61 (Jul. 1964).

Birkhoff, G., et al., "Explosives with Lined Cavities", *Journal of Appied Physics*, 19, 563–582, (Jun. 1948).

Davison, D., et al., "Optimization Process Giving an Exceptional Boost in Shaped Charge Jet Energy with No Weight Penalty", *13th International Symposium on Ballistics*, Stockholm, Sweden, 8 pgs., (Jun. 1–3, 1992).

DeFrank, P., "Industrial Applications of Conical and Linear Shaped Charges", *Symposium on Behavior and Utilization of Explosives in Engineering Design,* Americal Society of Mechanical Engineers, 251–255, (Mar. 1972).

Eichelberger, R.J., et al., "Experimental Verification of the Theory of Jet Formation by Charges with Lined Conical Cavities", *Journal of Applied Physics*, 23, 537–542, (May 1952).

Lee, W.M., "Metal/water Chemical Reaction Coupled to a Pulsed Electrical Discharge", *Journal of Applied Physics*, 69, 6945–6951, (May 1991).

Persson, A., et al., "Calculation of the Blasting Performance of Some Commercial Explosives", *Proc. 8th Symposium on Detonation*, 985–992, (Jul. 1985).

Pugh, E.M., et al., "Theory of Jet Formation by Charges with Lined Conical Cavities", *Journal of Applied Physics*, 23, 532–536, (May 1952).

(List continued on next page.)

*Primary Examiner*—Peter A. Nelson

*Attorney, Agent, or Firm*—Schwegman, Lundberg, Woessner & Kluth, P.A.

[57] ABSTRACT

The present invention relates to an innovative, safe, explosive device. The device has many potential fields of utility, including, but not limited to mining, oil exploration, seismology, and particularly to shaped charges. These shaped charges may be used as a well perforation system using energetic, electrically-activated reactive blends in place of high explosives. The reactive blends are highly impact inert and relatively thermally inert until activated. The proposed system requires no conventional explosives and it is environmentally benign. The system and its components can be shipped and transported easily with little concern for premature explosion. It also needs no special handling or packing. The performance in oil and gas well perforation can be expected to exceed that of conventional explosive techniques.

22 Claims, 2 Drawing Sheets

OTHER PUBLICATIONS

Saucier, R.J., et al., "A Laboratory Study of Perforations in Stressed Formation Rocks", *Journal of Petroleum Technology*, 1347–1353, (Sep. 1978).

Theofanous, T.G., et al., "Ignition of Aluminum Droplets Behind Shock Waves in Water", *Phys. Fluids*, 6, 3513–3515, (Nov. 1994).

Vigil, M.G., "Design and Development of Precision Linear Shaped Charges", *9th Symposium on Detonation*, 1385–1393, (Aug. 1989).

Walters, W.P., et al., *Fundamentals of Shaped Charges*, John Wiley & Sons, New York, (1989).

Walters, W.P., "Applications of the Shaped Charge Concept", *Journal of Explosives Engineering*, 7 pages, (Jan./Feb. 199).

ELECTRICALLY ACTIVATED, METAL-FUELED EXPLOSIVE DEVICE

BACKGROUND OF THE INVENTION

1. Field of the Invention

The present invention relates to explosive devices, such as those used in mining, oil drilling, seismology and the like, especially shaped charges, and particularly shaped charges with a directional projection, and more particularly to shaped charges which may be used as perforators in the mining and petroleum industries.

2. Background of the Art

The history of shaped charge conception and development is imprecise. In 1792, the mining engineer, Franz von Baader (1792) allegedly noted that one can focus the energy of an explosive blast on a small area by forming a hollow in the charge. It is said that Baader, in 1799, observed that if depressions or shapes were cut in an explosive and placed face down on a steel plate, the detonation would cause these shapes to appear on the plate. This is known as explosive engraving.

The original von Baader (1792) paper, however, primarily discussed bore hole drilling and loading, confinement effects on propellants, the positioning of a small air cavity between the explosive powder and the tamping (at best, a standoff distance effect), and rock fragmentation. His original paper did not discuss explosive engraving or hollow cavity charges. However, this is a moot point since von Baader used black powder, which is not capable of detonation or shock formation.

During World War II, many new military explosives and explosive devices were introduced. One impressive device was the lined-cavity shaped charge. This type of explosive charge was the basis for the effect of the bazooka against metallic armor and for the deep penetration of shaped demolition charges when fired against reinforced concrete.

After the war, attempts were made to put the extraordinary penetrating power of the lined-cavity shaped charge to use in industry, particularly in the mining industry. These attempts were particularly successful in the petroleum industry where the use of shaped charges has become commonplace. On the other hand, the use of shaped charges in the mining industry is virtually nonexistent.

The most desirable shaped charge devices, such as penetrators, use the most efficient and the most powerful explosives, both for the benefits of raw power in the explosion and the speed of the detonation reaction which plays a role in the physics of the jet and the propelled mass. The use of these types of materials is quite hazardous, both in on-site handling and in transportation to the site. Even though the materials used in the manufacture of the penetrators may be relatively inexpensive relative to the volumes used, and the actual manufacturing costs may be relatively low, there are significant additional costs involved in safety procedures during handling and shipping (including insurance) which add a significant component to the final costs, without any benefit to the manufacturer or user.

U.S. Pat. No. 5,479,860 describes an apparatus for perforating an earth formation from a borehole having a housing, a detonator assembly, explosive material for producing the implosion forces and a metal liner of implosive geometry. The detonator assembly includes a predetermined pattern of precision electronic detonators based on exploding foil initiator, exploding bridge wire, spark gap or laser technology to simultaneously produce multiple initiation points of the explosive material for enhancing the implosion forces.

U.S. Pat. No. 4,693,181 discloses improvements in hollow charges for linear cutting or demolition purposes wherein a bar formed from a composite of explosive material and a first pliant material has a V-shaped groove with a liner formed from a composite of particulate metal and a second pliant material. The metal may be copper and preferably the first and second pliant materials include the same constituents. The charge may include a casing having a spacing portion having an engagement surface for presentation to a work surface, which engagement surface is parallel to the outer edges of the liner and spaced therefrom to maintain an optimum stand-off distance. The casing may further include a groove filling portion of low density material which may be integrally constructed with the casing from a flexible material such as expanded polyethylene.

U.S. Pat. No. 4,762,067 discloses a perforating gun detonator. One embodiment is hermetically sealed while the other has openings therein to admit well fluids. In both embodiments, a narrow conductive metal foil is provided with a current to vaporize the narrow foil, explode the foil and propel a flyer driven by a shock wave for detonation of a spaced secondary explosive. The explosive then couples explosion into a detonating cord against a shoulder in a housing adjacent to the secondary explosive. The current is formed by means of an AC voltage multiplier circuit providing a charge on a capacitor which is discharged through a spark gap. Charging circuitry includes a blocking capacitor to prevent DC and a resistor for bleeding a small current from the capacitor to ground which prevents static or stray current accumulation.

U.S. Pat. No. 4,498,3678 describes determination of parameters for selecting materials for use as liners in shaped charges to transfer the greatest amount of energy to the explosive jet. Multi-layer liners constructed of metal in shaped charges for oil well perforators or other applications are selected in accordance with the invention to maximize the penetrating effect of the explosive jet by reference to four parameters: (1) Adjusting the explosive charge to liner mass ratio to achieve a balance between the amount of explosive used in a shaped charge and the areal density of the liner material; (2) Adjusting the ductility of each layer of a multi-layer liner to enhance the formation of a longer energy jet; (3) Buffering the intermediate layers of a multi-layer liner by varying the properties of each layer, e.g., composition, thickness, ductility, acoustic impedance and areal density, to protect the final inside layer of high density material from shattering upon impact of the explosive force and, instead, flow smoothly into a jet; and (4) Adjusting the impedance of the layers in a liner to enhance the transmission and reduce the reflection of explosive energy across the interface between layers.

U.S. Pat. No. 5,351,623 describes a device which safely simulates the loud noise and bright flash of light of an explosion. This device consists of an ordnance case which encloses a battery, an electronic control module, a charging circuit board, a bridge head, and a shock tube dusted with aluminum and an explosive. The electronic control module provides a time delay between initial activation of the device and the time when the device is ready to create a shock wave. Further, this electronic control module provides a central control for the electronics in the simulator. The charging circuit board uses the battery to charge a capacitor. Passing the voltage stored in the capacitor through the wires of the bridge head causes the explosive and the aluminum in the shock tube to react. This reaction produces a loud noise and bright white flash of light which simulates an explosion.

One other aspect of explosive devices which has been of great concern is the danger of premature detonation of the device or charge. The highly energetic release of the compositions used for providing explosions has usually been attended by a high degree of sensitivity or a low initiation threshold for the explosive reaction. Attempts at alternative energy sources for explosive devices have led in many directions, including the electrical ignition of metals in water. W. M. Lee, Metal/Water Chemical Reaction Coupled to a Pulsed Electrical Discharge, *J. Appl. Phys.* 69 (10), 15 May 1991 describes how capacitor stored energy is transferred to a wire conductor surrounded by a mixture of a reactive metal powder and water. The current explodes the small wire conductor and initiates a chemical reaction in the mixture. The chemical reaction in the mixture was direct reaction of the aluminum metal and the water as $$2Al+3H_2O \rightarrow Al_2O_3+3H_2$$

to provide the energy for the investigation of explosive sources.

T. G. Theofanous, X. Chen and P. Di Piazza, Ignition of Aluminum Droplets Behind Shock Waves in Water, *Phys. Fluids* 6 (11), November 1994, pp. 3513–15 describes the reaction of gram quantities of molten aluminum with water under sustained pressure pulses of up to 40.8 Mpa in a hydrodynamic shock tube. Conditions are identified under which the thermal interaction develops into chemical ignition and total combustion events in the aluminum-water explosion.

Electrically triggered explosive devices are not per se novel. Electrical current has been used for more than one hundred years to ignite detonators, as for example with TNT or dynamite charges. Electrical signals are also used with modem explosive devices, including Explosive Bridge Wires and their membrane equivalents. Explosive bridge wires are thin wire(s) placed adjacent to an explosive charge. The wire(s) or membranes (exploding foil initiators) are very thin and have very low mass relative to the total mass of the charge (considerably less than 1% by weight). These films or wire(s) are placed adjacent to the explosive mass, and are electrically connected to a charge generator. The charge causes the wire to burst, creating a shock wave into and through the explosive material which initiates or enhances the explosive effect of the charge. Explosive charges are generally oxygen deficient, but of course, may still react with the burst wire or foil in a redox reaction.

SUMMARY OF THE INVENTION

The present invention relates to an innovative, safe, explosive device. The device has many potential fields of utility, including, but not limited to mining, oil exploration, seismology, and particularly to shaped charges. These shaped charges may be used as a well perforation system using energetic, electrically-activated reactive blends in place of high explosives. The reactive blends are highly impact inert and relatively thermally inert until activated. The proposed system requires no conventional explosives and it is environmentally benign. The system and its components can be shipped and transported easily with little concern for premature explosion. It also needs no special handling or packing. The performance in oil and gas well perforation can be expected to exceed that of conventional explosive techniques.

The fundamental approach of the present invention is to activate reactive blends of metals and oxidizing agents with energetic electrical pulses from a pulsed-power system. Theoretical predictions of pressures and expansion histories can be verified by testing reactive samples activated with energetic electrical pulses. The energy source of choice is a conductive material which can be burst (e.g., melted and vaporized by pulsed electrical current). Of particular interest are conductive materials such as graphite, conductive polymers and metal such as aluminum, zirconium, copper, titanium, lithium, silver, magnesium, beryllium, manganese, tin, iron, nickel, zinc, boron, silicon and the like in an oxidizing environment, or an environment which becomes oxidizing during the pulsing, bursting and subsequent reaction initiation. It is also desirable to have a power source and conductive path to the reaction mixture that will remain effective in the difficult temperature, stress, and shock environment in which the unit will be employed.

DETAILED DESCRIPTION OF THE INVENTION

Figure 1A:
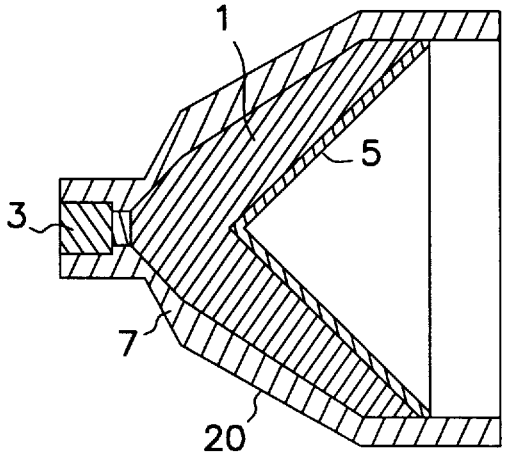
FIG. 1 shows cross sections of two simple lined-cavity shaped charges, 1 (*a*) of the prior art and (*b*) of the present invention.

An explosive device, which is best illustrated as a shaped charge, is described in the practice of this invention. The explosive device may comprise merely a casing, reactive blend and electrical path to the reactive mixture. The shaped charge comprises a shaped casing and liner which defines a cavity and a reactive mass of material within said cavity, wherein said reactive mass comprises an electrically conductive distribution of metal (such as zirconium or preferably aluminum metal) and a material which will oxidize said metal at a temperature of at least 1000° K., and usually between 1000° K. and 7000° K. The reactive mass distribution or mixture is oxidatively stable at room temperature (that is, less than 5% by weight of the aluminum will oxidize at 25° C. in a thirty day period while in contact with only said material within the casing and liner which will oxidize said aluminum metal at the elevated temperature range) and may be activated or detonated by a pulsed electrical charge of at least 1 kJ/gram of aluminum, often at least 3 or 5 kJ/g, preferably at least 7 kJ/g, and under some circumstances at least 10 kJ/gram of reactive mixture (e.g., the total combined weight of aluminum and oxidative coating). This high energy/volume of pulsed power should be delivered in proportion to the total mass and/or length of the explosive mixture. A general guideline is that the duration of the pulse should be less than about 100 microseconds per gram of reactive mixture for conventional type explosive devices. As the length of the mixture (by way of shape or mass increasing the dimension along which the activating pulse charge must flow), the duration of the pulse must also increase. For shaped charges, the guideline is that less than about 0.20 microseconds/gram, preferably in less than 0.15 microseconds/gram, and more preferably less than 0.10 microseconds/gram. Commercially available generators are capable of providing that energy fluence necessary for initiating and maintaining the reaction in less than 5 or even less than 2 microseconds.

Another aspect of the present invention is the fact that an absolute minimum pulsed charge must be present to initiate the explosion. Running smaller currents through the reactive mass may cause progressive oxidation, but will not initiate the bursting and rapid oxidation that is part of the reaction scheme in the use of the explosive device of the present invention. This threshold pulse value will be dependent upon both the size of the reaction mass, the length of the mass, and the specific reactive conductor (e.g., metal) and oxidizing agent selected. For the non-shaped, non-jet charges, the threshold value (and fluence, i.e., energy/time, such as kJ/g/microsec.) is lower than for the shaped, jet charges (such as the perforators of the present invention). For a simple explosive device, there could be a minimum threshold fluence of 0.1 kJ/g/50 microsec., 0.3 kJ/g/25 microsec., or 0.5 kJ/g/20 microsec. and higher. For the shaped, jet producing charges, such as the perforators, this threshold fluence could be at least 0.5 kJ/g/25 microsec., or 1, 3, 5 or even 10 kJ/g/20 microsec. This feature provides a level of safety for the explosive device that can be controlled to a point where nothing short of a bolt of lightening could accidentally cause premature detonation of the explosive device.

The reactive mass has been described as a conductive reactive mass. This means that the pulsed charge must have a continuous conductive path through the reactive mass. A suspension of conductive particles in an insulating, albeit oxidative medium, would not be able to provide the continuous reactive path desirable for the reaction to proceed along the entire length of the reactive mass. By conductive it is generally meant that at room temperature and ambient conditions at voltage levels which do not significantly alter the conductive properties of the material itself (as would the bursting pulses used in the present invention), the reactive mass (through the conductive element) would display a resistance of greater than 1 microohm-cm and less than 100 microohm-cm.

The reactive mass of conductive reaction material, such as the metal (aluminum will be used specifically in the remainder of the discussion, but conductors and metals in general are implied) and oxidizing material has been termed a distribution or mixture because many different presentations or combinations of these materials can work within the practice of the present invention. The simplest form would be a physical admixture of aluminum powder (which has been sintered to provide the conductive path) and the oxidizing material (as a solid, liquid or least preferably a gas). The particle size of the aluminum powder would probably be less than 10 micrometers, more likely less than 8 micrometers, preferably less than 5 micrometers, and more preferably less than or equal to about 3 micrometers. As long as the oxidizing material releases the oxidizing agent into a fluid phase readily at the activation temperature generated by the pulsed signal, the particle size of the oxidative component is less important. The desirability of small particle sizes is influenced by the desired speed of the reaction. Where an extremely fast reaction is desired, as with the shaped charges for perforators, smaller particles sizes (or thinner wires or ribbons) are useful. The particle, wire or ribbon size and thicknesses are not as important when the slower reaction times are tolerable, as with the blast applications.

Another simple form for the provision of a distribution of aluminum and oxidizing material would be to provide a mesh of aluminum wires in an oxidizing material, either filling the interstices of the mesh or coating each individual filament or fiber in the mesh. The use of wires is advantageous as they provide a natural conductive path through the reactive mass along the wires. Aluminum wires which are individually coated may be overlaid (rather than woven or knitted as in the mesh), entwined, or in other was distributed within the cavity. The fibers may be position parallel to each other with coatings of oxidizing materials over each fiber of in any other way provided in close proximity to the aluminum filaments or fibers. Wires may be wound in concentric circles or helices around the liner or other core, the individual wires may be insulated with an oxidizing covering (e.g., polytetrafluoroethylene, Kevlar™, polyethers, or other polymers which provide large amounts of oxidizing moieties when heated or vaporized), they may be immersed in a matrix of oxidizing material, wires of metal and oxidizing material may be laid parallel to each other, and/or combination of these arrangements may be used.

One objective of the arrangement of the materials is to provide a large surface area for the aluminum material so that the reaction can take quickly. Even though the initial effect of the pulse and initial reaction of the aluminum and the oxidizing material will be to melt, explosively particulate, and/or vaporize the aluminum so that it may readily react with the oxidizing environment around the aluminum, the use of fine aluminum material initially in the cavity provides desirable effects on the performance of the system.

The oxidizing material does not have to provide oxygen itself as the oxidizer, but may provide fluorine, chlorine, bromine, iodine or other mono- di-, tri- or tetra-atomic atomic oxidizing agents (e.g., $O_2$, $F_2$, CO, $NO_2$, etc.) into the environment at the elevated temperatures so as to react rapidly with the aluminum. Polytetrafluoroethylene (e.g., Teflon™), Kevlar™, highly fluorinated (or halogenated) organic compounds and materials, highly oxygenated materials (e.g., polyethers, peroxides, and the like), and mixtures, solutions, emulsions or dispersions of such materials may be used to provide the oxidizing materials at the elevated temperatures brought on by the pulsed detonation signal and/or the initial reaction brought on by the pulsed signal. The oxidizing material may be comprise more than one material and may be placed into more than one position. For example, one type of oxidizing material may be an insulating cover on the wires, and another oxidizing material may be present between the insulated wires.

As noted earlier, explosive bridge wires and membranes, with very low wire mass to explosive mass, are known in the art. One additional description of the charges of the present invention which further distinguishes from those devices is the ration of wire to oxidizing agent in the reactive mass. It is unlikely that ratios outside the range of 3:1 to 1:3, (either weight to weight or molar equivalent to molar equivalent) wire to oxidizing agent, would be highly desirable. Ratios approaching stoichiometric equivalence are more efficient and desirable, with ranges of ratios between 2:1 to 1:2,1.5:1 to 1:1.5,1.25:1 to 1 to 1.25 and 1.1:1 to 1:1.1 being more preferred.

A conventional prior art explosive perforator 20 as shown in 1*a* comprises at least four components, a booster 3, a casing 7, an explosive 1 and a liner 5. The electrically activated perforator 30 of the present invention comprises an electrical connection point 4 (which may be a cable, particularly a shielded cable), a casing 8, a reactive mass 2 (e.g., here a coiled, insulated aluminum wire in an insulating and oxidizing material, with the ends [not shown] of the individual wires 14 electrically connected between said electrical connection point 4 and said casing 8), and a liner 6 to form a shaped charge jet (not shown). The electrical connection point 4 may be an electrical contact to which the electrical charge source may be attached (by either a male, female or snap connection) or as previously noted, may be a cable extending out from the casing to the reactive blend.

The electrical connection must be in electrical contact with the reactive blend so that the charge which enters the device to initiate reaction/detonation of the reactive blend can be conducted to the reactive mass. An insulator 10 may be located between the current source (not shown) and the liner 6. The liner 6 will lose its conductivity at the end of the current pulse, commutating the current from the conductive reactive mass 2, causing a high magnetic field which helps accelerate the liner 6 as it collapses during the explosion. A conductive insert 12 may be present to provide a continuous electrical path between the liner 6 and the casing 8 during the collapse of the liner 6. It is possible to provide an additional safety feature to the system by providing a movable (open to closed) contact or switch within the casing where the electrical signal would enter. This would even provide some protection against a premature electrical signal, since the signal would also have to pass across an off circuit.

The liner used in a shaped charge can take any of a number of forms, including conical, hemi-spherical and pyramidal. To be effective, the liner must be fairly symmetrical about the charge axis. On the basis of ease of manufacturing, low cost and reliable performance, the conical liner has become widely used, but pyramids made of flat plate segments also appear to work well in some circumstances. Successful liners have been made of many materials including metals, glasses and ceramics.

The charge body contains the explosive and holds the liner in position. For usage in the open, the charge body should be frangible so that lethal fragments are not scattered during detonation of the device.

The function of a lined-cavity shaped charge is to convert the liner into a high velocity rod-like mass of material called a jet. The useful work which a shaped charge can perform is the result of the ability of the high velocity jet produced in the detonation to bore a hole into a target material, whether it is a steel plate, reinforced concrete, or rock and earth.

Formation of a jet takes place when the detonation wave in the explosive portion of the shaped charge sweeps across the liner. The liner collapses to an essentially solid piece of material called the slug and, at the same time, a portion of the liner is expelled with a very high forward velocity to create the jet. Jet velocities in the range of 20,000 to 30,000 feet per second are easily achieved.

The impact of a jet of copper, steel or cast iron jet against a massive target results in the formation of a relatively deep, narrow bore hole. With a metallic target, the metal encountered by the jet is forced aside and the target does not lose any appreciable mass but rather becomes a little thicker or a little larger in diameter. In rock and earth material targets, the bore hole is formed by the expulsion of target and jet material (in the form of a "back-blast") and by the compaction of the target material. Compaction occurs through grain deformation and the collapse of the porosity in the rock immediately adjacent to the bore hole.

The point of jet entry into a strong brittle target mass such as a hard rock is normally accompanied by the formation of a crater. The extent of cratering is closely related to the amount of strain energy stored as grain deformation adjacent to the bore hole formed in the target mass. For a given shaped charge, the size of surface crater is determined by the rock type, the amount and depth of weathering, and the amount of alteration.

The Liner

Probably, the most important shaped charge design element is the liner which may be a metallic or nonmetallic liner. The variables associated with the liner are the liner material and the liner geometry. The liner geometry can consist of a multitude of arcuate devices. The most popular are the cone, hemisphere, tulip, trumpet, the dual-angle cone (also called the biconic liner), Misznay-Schardin liners or ballistic discs or P charge liners (also known as self-forging fragments or explosively formed penetrators), tandem devices, and combinations of all these, such as a cone attached to the open apex of a hemisphere (i.e., a hemicone).

Once the geometric configuration is established, a pertinent variable is the liner diameter, where the term liner diameter refers to the outer diameter of the liner. In general, the bigger the liner, the longer the jet and the greater the penetration capability.

In general, military liner diameters range from the 1 to 2 in. size used in research devices or bomblets up to 12 in. or so as used in torpedoes. However, larger and smaller shaped charges have been employed for special applications, including industrial applications. Smaller charges (1–2 in. or less) are more difficult to fabricate to the required tolerances. Large liners are also difficult to fabricate because of their size, and are also difficult to load. Loading is difficult due to the large height and diameter of the explosive fill, which may exceed the capabilities of the explosive pressing or casting facilities. In this case, loading is carried out in stages. In addition, for very large or very small liners, control of the metallurgical and mechanical properties of the liner material is difficult. Army rounds sometimes are required to be man portable. This requires the warhead weight (or diameter) to be as small as feasible.

The Liner Wall Thickness

Another critical liner design variable is the wall thickness. Typically, uniform wall thicknesses range from about 1 to 4% of the charge diameter. However, liner wall thicknesses of up to 8% or so have been used, and with appropriate selection of materials, thicknesses up to 15% are conceivable. The charge diameter is the outer diameter of the explosive fill and is, of course, always greater than or equal to the liner diameter. The charge diameter will be discussed later in this chapter. The wall thickness chosen depends on the liner geometry, the liner material, and the required properties of the jet in reference to its intended application. Note that in optimum charge design, the fabrication method and geometry would be insignificant. The design is governed by the intended application and the imposed constraints.

In addition, the wall thickness contour need not be uniform but may be tapered. A smooth taper, where the liner is thick at its pole or apex and thin at its equator or base, is simply called a taper. If the smooth taper results in a liner that is thin at its pole or apex and thick at its equator or base, the liner is said to have an inverse taper. The taper, in either direction, does not have to be smooth, but care should be taken to avoid sharp discontinuities or sharp thickness variations in the liner. Otherwise, the liner may particulate early according to the location of these discontinuities resulting in a poorly formed jet. The resulting jet then may not be an effective penetrator. The taper usually occurs on the inside (or air side) of the liner, away from the side of the liner in contact with the explosive, although this is not always the case. Basically, tapering the liner allows the designer to control the jet velocity gradient, jet length, and to an extent, the breakup time. In general, thin walled liners can be accelerated to higher velocities than thick walled liners.

The Liner Apex Angle

Another pertinent variable necessary to describe the liner is the liner apex angle (in the case of conical-like liners) or the altitude (or depth) for other geometric shapes. For a cone, the smaller the apex angle, the tendency is towards a faster the jet tip velocity and a lower the jet mass. Liners with a wide apex angle have a slower tip velocity and are more massive. Very wide apex angle cones begin to approximate hemispherical liners or arcuate devices such as explosively formed penetrators. A large depth or altitude of a nonconical liner implies more liner material available and a greater surface area in contact with the high explosive. This should result in a greater length of penetrator and hence a deeper penetration than a device with a shallower depth.

If one considers the various altitudes, diameters, wall thicknesses, and wall contour tapers that are possible for each of the arcuate geometries mentioned earlier, a multitude of geometric designs are possible. However, the various geometric designs have a different mode of collapse and jet formation, and this can greatly influence the resulting properties of the jet.

For narrow-angle (low apex angle) cones, the tip velocity and stretch rate are higher than for wide-angle cones. In fact, cylindrical liners, usually tapered to simulate a small apex angle cone, are capable of producing very fast jets. Except for cylindrical charges, conical apex angles of 30° to 120°, depending on the liner material, are popular. Variations to the conical liner geometry, other than those already mentioned, include alteration of the conical apex region. The apex may be sharp, rounded, or blunt with a truncated cone. These variations affect the lead particle of the jet, the jet tip velocity, the jet tip mass, and the jet velocity gradient and mass distribution.

Nonconical Liners

The tulip and trumpet liners collapse similar to a conical liner, although the tulip liner, or elliptical liner, may behave like a hemispherical liner depending on its overall warhead configuration design. Also, trumpet liners typically have a high tip velocity and do not possess the inverse velocity gradient characteristic of conical liners. The hemispherical liners exhibit an entirely different mode of collapse than conical liners. The hemispherical liner is inverted from the pole or turned inside out. This results in a lower strain rate, less severe deformation process than the violent collision on the axis that conical liners undergo. Thus, the design of hemispherical and tulip-type liners must take into account the nature of the formation process.

For explosively formed penetrators (EFPs), self-forging fragments, P charges, dish-shaped devices, spherical caps, Misznay-Schardin devices, or the like, the collapse and formation depend to a large extent on the explosive geometry, the confinement geometry, and the metallic liner geometry. For example, under the proper conditions, one can form a projectile from a rearward-folding device (pole or apex of the liner emerges first) or a forward-folding device (tail or wings or base of the liner emerge first) or a W-fold device (where the liner forms into a W shape and collapses upon itself). Each of these devices may be generated by various tapers of the liner wall thickness and a confining body. A point focus device employs a uniform wall thickness liner and attempts to focus all liner material into a single point. The W-fold device and the point focus device are used to produce compact spheres or oblate spheroids. Forward- and rearward-folding devices are used to produce continuous rods or projectiles, which hopefully will stretch and elongate, but will not particulate, or if they do break, they will consist of only two or three segments. For the short EFP slugs, the initial stretching rate is much less than for a shaped charge. Thus, the effect of the free ends can propagate through the slug before actual breakup occurs. Therefore, the EFP breakup is more sensitive to small changes in material strength than the breakup of shaped charge jets. In addition to spheres and long rods, other shapes can be formed including hollow caps and rods with a flared, conical base to provide aerodynamic stability.

EFPs typically are low-velocity devices (as compared to shaped charges) and yield a tip velocity of 2–3 km/s. However, they generate large diameter, high mass projectiles and produce large holes in the target material. The penetration does not diminish rapidly over a long standoff (tens of meters) if the projectile is aerodynamically stable. Air drag and tumbling, if the projectile is unstable, are the main causes of degradation of penetration with standoff. At short standoff distances, the performance is poor since the penetrator must have time, and hence distance, to form. Optimal penetration (at the appropriate standoff) is usually about one to two charge diameters into steel. Again, confinement effects and explosive geometry also influence the formation and performance. Increasing the L/CD of the EFP warhead increases the jet kinetic energy.

Combinations of spherical caps or hemispherical liners and conical liners are possible. Such devices are constructed by removing the apex region of a hemispherical liner and covering the opening with a cone or another hemisphere, or using a conical liner with a hemispherical apex region. These devices can be contoured to form continuous jets or to form two distinct jets where one jet leads the other in space and time. Shaped charge devices of this type are useful in producing a "prejet," or precursor jet, to remove elements positioned between the warhead and the target, such as a seeker or guidance package on a missile carrying the shaped charge.

For combinations of charges such as conical-spherical, conical-conical, and so on, the two liners may be blended together to form a smooth transition between them or they may be joined by a sharp geometric discontinuity. If the charges are carefully blended together to form a continuous jet a new geometric configuration may result, for example, the trumpet liner.

If the apex region of a conical liner is removed and replaced by another conical liner, the resulting liner is called a dual-angle or biconic liner. Note that in the literature, devices of this type are sometimes called tandem liners.

Of course, many other liner shapes and contour variations are possible. Only some of the more popular liner shapes have been described here.

The Explosive Fill and Initiation Mode

The next design variable to be addressed is the explosive fill. Usually, more energetic explosive fills yield faster jets, a greater jet kinetic energy, and deeper penetration. Table 1 summarizes the effects of previous explosive detonation rate and detonation pressure. LX-14 is 95% HMX and PBXW-110 is 78% RDX. The Octol is 70/30 (70% HMX, 30% TNT), and Comp B is 60% RDX, 40% TNT. Pentolite is 50% PETN and 50% TNT, and Amatex 40 is 40% RDX, 40% TNT. The densities and detonation velocities are as given in Table 1. The detonation pressures are approximated by $$P(\text{kbars})=0.25\rho(\text{g/cm}^3)D^2(\text{m/s})\times10^{-5}.$$

The penetration and lethality effectiveness increase as the detonation rate and/or the detonation pressure increases. From Table 1, LX-14 would be the most effective, and TNT the least effective, explosive for shaped charge studies. The target hole volume increases with specific explosive energy in an approximately linear fashion. The explosives are ranked according to their penetration and lethality effectiveness. Thus, a high detonation velocity and high detonation pressure explosive is desirable although other factors, such as sensitivity, grain size, and homogeneity, must be considered.

TABLE 1

| | Explosive Properties | | | | | | |
|---|---|---|---|---|---|---|---|
| | LX-14 | PBXW-110 | 70/30 Octol | Comp B | Pen-tolite | Amatex 40 | TNT |
| Density ($g/cm^3$) | 1.835 | 1.75 | 1.80 | 1.72 | 1.67 | 1.63 | 1.61 |
| Detonation rate (m/s) | 8830 | 8480 | 8300 | 7900 | 7470 | 6900 | 6800 |
| Detonation pressure (kbars) | 358 | 315 | 310 | 268 | 233 | 194 | 186 |

Charge Diameter

The diameter of the explosive charge, referred to as the charge diameter, or CD, not to be confused with the cone diameter as sometimes happens, is an important design variable. The ratio of the liner diameter to the charge diameter is termed the subcalibration ratio. The subcalibration ratio required depends on the liner and confinement geometry as well as the liner and confinement materials and the explosive used. It is generally agreed that explosive near the base of the liner is necessary to enable the wings or base of the liner to adequately collapse and participate in the penetration process. The control of the liner subcalibration ratio is critical in the formation of forward-folding or backward- (rearward-) folding self-forging fragment (SFF) or EFP liners. Additional subcalibration is used to form implosive hemispherical or near-hemispherical devices. The charge diameter (CD), or outer diameter of the explosive fill, is the reference unit for normalizing shaped charge performance. Thus, to allow comparison between rounds one usually plots penetration versus standoff distance both normalized by the CD.

Charge Length

The length of the explosive charge (L) is necessary to provide a sufficient amount of explosive energy for the liner collapse process. The height of explosive between the apex or pole of the liner and the booster is called the head height. The head height must be large enough to allow, as close as possible, a uniform (planar) detonation wave to reach the liner for a point-initiated charge. To short a head height causes a highly spherical wave to impact the liner and the collapse may be nonuniform. Rarefaction effects are also more likely to be detrimental. Typically, the tip velocity, jet kinetic energy, and penetration of the jet (recall we are only addressing penetration into monolithic targets) increases as the head height increases, up to a point. A head height of about 1.5 CD provides a value beyond which very little improvement in penetration capability is achieved. Usually a 1 CD head height is ample and a head height of ⅝–¾ CD results in a very small penalty in penetration power for point-initiated conical or hemispherical lined charges. Some investigators use the charge length (the total height of the charge, L) as the pertinent parameter, that is, the charge length is sometimes confused with the head height in the literature. For point-initiated, conventional charges with a subcalibration ratio less than one, adequate L/CD values range from 1.3 to 1.8.

It is usually desirable to keep the head height or charge length to a minimum to reduce the length of the device and to save weight. Several methods are available to accomplish this. This simplest method is to remove unnecessary explosive by tapering the rear of the charge, that is boattailing. Care must be exercised in choosing the break point (or point where the geometric discontinuity commences) to avoid the interference of rarefaction waves on the liner collapse. Usually, the break point occurs just aft of the liner apex or pole. Typically, only about 10–20% of the total explosive chemical energy is translated into penetrator kinetic energy.

Another technique used to shorten the head height is waveshaping. Waveshaping involves inserting a device in the explosive charge, usually near the detonator or near the apex or pole of the liner, to contour, redirect, or shape the detonation wave to the required geometry in a short distance. Waveshapers are also used to alter the collapse of the liner by changing the angle of incidence of the detonation wave, and thus even enhance performance from a short head height device. Successful waveshapers have been constructed from air, explosives, plastics, ceramics, metals, and even concrete. In addition to the waveshaper material, the other variables involved in waveshaper design are the location of the device in the explosive fill and its geometry and size.

For the explosive fill in general, both cast and pressed explosives are possible, and both are widely used (e.g., Octol and LX-14). In either case, care must be taken to guarantee a uniformity in the density and distribution of the particles (e.g., HMX crystals). Also, it may be necessary to control the grain size of the HMX or RDX particles in the explosive. For example, the median weight average diameter of the HMX grain in 75/25 Octol is about 500 $\mu$m and the median weight average diameter of the HMX grain in LX-14 is around 110 $\mu$m. A good, tight contact must also be obtained between the explosive and the liner or asymmetries may result.

Also, just as ways of tapering or contouring the metallic liner have been investigated, the explosive can be tapered or contoured, in conjunction with the confinement body and the liner contour, to control the charge to mass ratio and enhance the collapse of the jet. This is done to optimize the velocity gradient to control jet length, breakup time, and penetration performance.

So far, a point initiation of a shaped charge device has been emphasized. A point initiation consists of a detonator-booster combination attached at a single point, on the centerline of a cylindrical or boattailed explosive charge. Other modes of initiation are possible, usually designed to shorten the head height or to enhance the collapse and/or performance of the jet. These alternate methods include peripheral initiation or simultaneous initiation around the circumference of the charge, which is another way to reduce the head height, but can cause detonation wave interactions near the pole or apex of the liner. Peripheral initiation can also be achieved by a single point initiation and a waveshaper.

Various types of lens systems, for example, an air lens (using an air-HE system) or a binary lens (using two different types of HE in contact and of different detonation rates) are also used. These devices reduce the head height, may enhance the performance, and are used in implosion devices, which cause the liner (usually hemispherical) to focus at a given point or region before jetting. Also, multipoint initiation devices, which are designed to initiate the secondary explosive at several points simultaneously, and thus form the desired wave contour over a relatively short distance, are sometimes used. Simultaneous initiation over an explosive surface can also be achieved by propagating an explosively generated shock wave through a metal plate. Devices of these types are sometimes termed plane-wave lenses.

In addition, special effects can be achieved by offsetting the detonator-booster combination or by offsetting the liner. Either technique can cause the jet to form at some angle displaced from the centerline of the warhead.

The liner and explosive fill combination is also coupled to the confinement or body influence. The confinement, which is a metallic or fiber casing around the explosive charge diameter, is used to assist in loading the charge with a cast explosive; to provide a fragmenting, antipersonnel device based on the fragmentation of the case; or to keep the detonation pressures high and thus alter or maintain the velocity gradient of the jet. A heavy confinement could allow use of a smaller amount of explosive by preventing the premature release of explosive energy. The outer diameter of the confinement body is called the warhead diameter. It may be thin and of a low-density material such as aluminum (perhaps designed to absorb the launch loads from a gun or missile) or thick and fabricated from a stronger material such as steel. For some applications, such as man-portable rounds, the heavy confinement is usually avoided to save weight.

The Body Confinement

As coupled with the explosive and liner contour, the material and the geometric shape of the confinement body is influential. The body may be tapered to create a localized high-pressure effect, called tamping, or it may be uniform, to uniformly increase the detonation pressure, or tapered to regulate the velocities of the liner and the confinement. The confinement, including its material and geometry is quite influential in determining the method of formation of self-forging-fragments or EFPs, especially forward-folding and rearward-folding devices.

For shaped charge jets the confinement geometry is influential in controlling the jet velocity gradient, and for well-aligned and assembled charges, the performance increases at long standoff distances but is nearly the same as unconfined charges at short and moderate standoff distances. Confinement rings are sometimes required to prevent the detonation products from escaping from the base of the liner. These rings may be as heavy as the confinement thickness. There is an upper limit on the thick confinement of the liner since maintenance of pressure on the liner after collapse is unimportant. Thus, further increase in confinement thickness does not lead to a further increase in jet performance. For steel, a heavy confinement wall thickness of about 1/10 CD is the maximum reasonable value.

Other techniques are available to enhance or inhibit the collapse of shaped charge devices by either varying the explosive-confinement-liner interaction or by introducing additional devices. Localized confinement, that is, a single metallic band around the charge diameter of a warhead can locally enhance the collapse. Extraneous devices such as plastic, or metal, or even liquids positioned inside (on the air side of) the liner can inhibit the collapse process. Other methods of enhancing, disrupting, or inhibiting the collapse to produce specialized jets for specific purposes are possible.

Results of TIGER Analysis

| Reactants (Blends Are by Weight) | Density of Reactants ($gm/cm^3$) | Energy in Metal, Reactants (kJ/gm) | Type of Reaction | Peak Pressure (kbar) | Temperature at Peak (°K.) | Work (kJ/gm) at $V/V_0$ = 2, 10 |
|---|---|---|---|---|---|---|
| Comp. A-3 | 1.65 | —, 5.4 | Detonation | 278 | 2730 | 5.6, 6.8 |
| Al/Water | 1.46 | 10, 12.9 | Explosion | 113 | 5200 | 3.0, 5.0 |

-continued

Results of TIGER Analysis

| Reactants (Blends Are by Weight) | Density of Reactants ($gm/cm^3$) | Energy in Metal, Reactants (kJ/gm) | Type of Reaction | Peak Pressure (kbar) | Temperature at Peak (°K.) | Work (kJ/gm) at $V/V_0$ = 2, 10 |
|---|---|---|---|---|---|---|
| Al/Water | 1.46 | 20, 17.9 | Explosion | 143 | 6640 | 3.7, 6.4 |
| Al/Water | 1.46 | 5, 10.4 | Detonation | 134 | 5050 | 3.7, 5.3 |

Evidence of increased performance with activated aluminum/water:

Reactant energy for an activated aluminum/water blend can be more than twice that of Composition A-3 (91/9 RDX/Wax).

Pressures are acceptable (greater than 100 kbar).

Work at moderate expansion ($V/V_0$=10) equals that of Composition A-3; at large expansion, the work will be greater than Composition A-3.

Figure 2B:
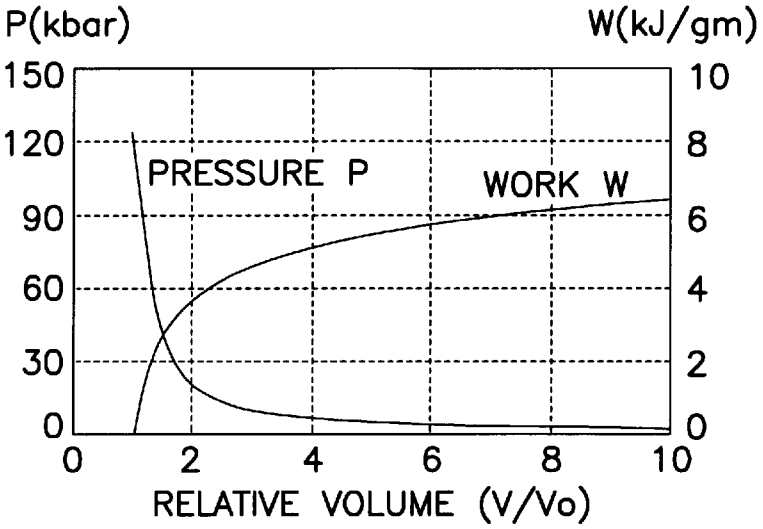
FIGS. 2A and 2B show graphic representations of Work W produced by Relative Volumes (V/Vo) for composition A-3 when detonated (FIG. 2A) and for 50/50 Aluminum/Water when exploded after deposition of 20 kJ/gm into the Aluminum (FIG. 2B).
Figure 2A:
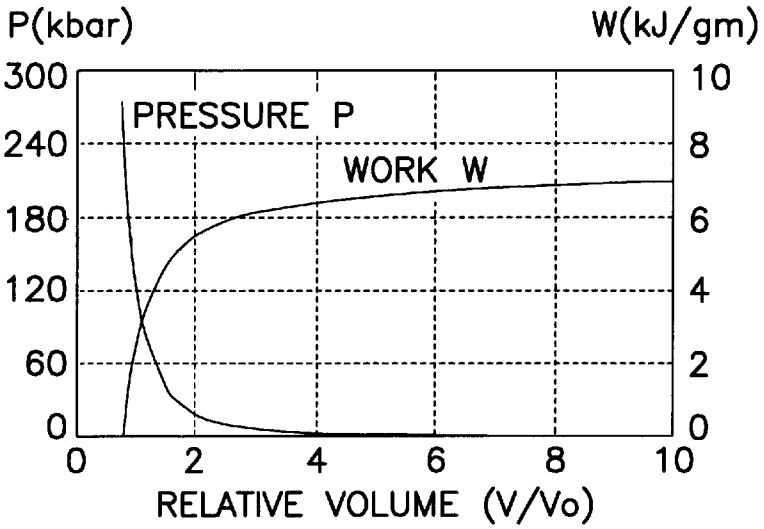

As shown in FIGS. 2A and 2B, at a relative volume of 10, 50/50 aluminum/water, plus deposition, produces as much work as Composition A-3.

DESCRIPTION OF PERFORATOR OPERATION USING PULSED POWER AND OXIDATION REACTIONS AS A SAFE EXPLOSIVE

Figure 1B:
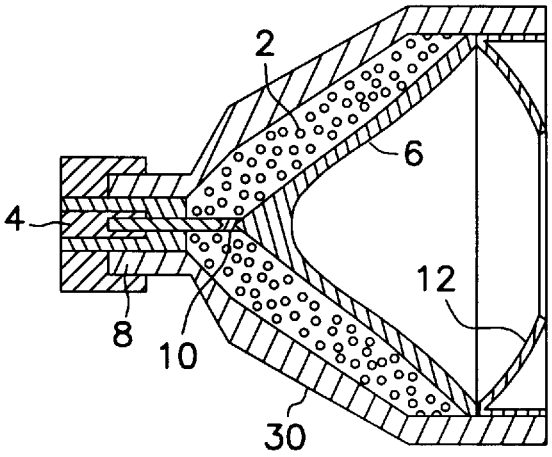

FIG. 1(*b*) is a sketch of a typical electrically-activated perforator according to the present invention in which current is supplied by an external pulsed power source through the co-axial connection at the rear. Note that current from the center conductor of the coaxial feed is injected into a metal wire or wires that are wrapped circumferentially about the metal liner in layers so that current can flow in series and/or parallel depending on the requirements of the load. Each wire is covered by a sheath of insulating material that is chosen to be both an insulator during heating and an oxidizer after burst of the metal wire. In addition the insulated coiled wire or parallel wires will be immersed in an additional oxidizing medium contained between the liner and the outer confinement. There are two stages in the operation of the perforator:

(1) Sufficient energy is coupled to the wire(s) via Joule heating to cause the wires to "burst", i.e., enough energy is deposited in the wire(s) to cause the wire to go through two phase transitions (solid to liquid and liquid to vapor). The energy must be rapidly deposited into the wire to cause the oxidation reactions to occur rapidly(~2 microseconds) to achieve high pressures (~100 kB) to cause the liner to collapse on axis thereby forming a jet of rapidly moving material that can be used to penetrate solid objects. Oxidation reactions will not only occur between the wire and its insulator but with the oxidizing medium as well. Selection of the oxidizing medium will not only be determined by its ability to oxidize the material in the wire but also by what by-products will result which can act as the best working fluid on the surface of the liner.

The time to burst is determined by the "action" which is the integral of the square of the instantaneous current over time. The action has the units of an energy/unit resistance and is equal to $\rho A^2 C/\eta(T)$ where $\rho$ is the density of the wire, A is cross-sectional area, C it specific heat and $\eta(T)$ is the temperature dependent resistivity of the wire. Note that ~60% to 70% of the energy is deposited into the wire during the latter 25% of the time interval.

(2) The second phase of the operation occurs because as the oxidation reactions reach completion all of the available of conductive metal in the wire(s) will have been transformed into oxides of low conductivity. The removal of this material leads to the original path of the current becoming highly resistive leading to a very large inductive voltage transient, i.e., the original current path begins to act like an opening switch which will allow the commutation of the remainder of the current to flow along the rear of the liner leading to additional collapse forces on the rear of the liner. As the current flows along the surface of the liner in contact with the chemically reacting a magnetic pressure is exerted on it surface given by $P=B^2/2\mu_0$, where $B=\mu_0 I/2\pi r$ is the magnetic flux density, $\mu_0$ is the permeability of free space, I is the instantous current and r is the radius of the liner at a given axial position. Hence $P=\mu_0 I^2/(8\pi^2 r^2)$ showing that the magnetic pressure is inversely proportional to the square of the liner radius, i.e., the magnetic pressure will increase as the liner approaches the axis. These pressures range from ~15 Bar at 100 kA at a radius of 1 cm to ~1.5 kB at 1 MA and the same radius. With appropriate contouring of the liner more energy and mass will be coupled into the jet leading to a larger penetration volume and/or a deeper penetration hole.

To prevent early flashover between the center electrode of the coaxial connection and the apex of the liner an insulator cap 10 can be put over the apex of the liner to withstand voltages anticipated during the operation of the first stage of operation of the liner but sufficiently thin to allow flashover during the high voltage inductive spike during the high resistive phase. To ensure current continuity during liner collapse, the conductive insert 12 at the base of the liner must be contoured such that it will maintain contact. The combination of the high pressures due to the oxidation reactions and the electromagnetic forces on the rear of the liner will lead to efficient collapse of the liner and the formation of an effective jet for penetration. As the resistance in the load increases there is also a corresponding increase in the inductive voltage drop which can be used to switch the current from the oxidation reaction region to the surface of the collapsing liner.

What is claimed is:

1. A shaped charge capable of projecting a mass which can perforate a solid object, said shaped charge comprising:

a) a casing, b) an electrical connection means though said casing, c) a reactive mass within said casing, wherein said reactive mass is electrically conductive along its entire length, and said casing encloses said reactive mass, said reactive mass comprising an electrically conductive reactive material in association with an oxidizing agent.

2. The shaped charge of claim 1 wherein said electrical connection comprises an insulated cable passing though one end of said casing.

3. The shaped charge of claim 1 wherein said electrically conductive reactive mass comprises aluminum metal wire and an oxidizing agent.

4. The shaped charge of claim 3 wherein said aluminum metal wire is covered with an insulating material which acts as an oxidizing agent when said aluminum metal is vaporized.

5. The shaped charge of claim 1 wherein said electrically conductive reactive mass comprises metal filaments and an oxidizing agent.

6. The shaped charge of claim 5 wherein said filaments are wrapped in concentric circles or helices around said liner.

7. The shaped charge of claim 3 wherein said aluminum wire is wrapped in concentric circles or helices around said liner.

8. The shaped charge of claim 7 wherein an insulator is present between said casing and said electrically conductive reactive mass.

9. The shaped charge of claim 2 wherein an insulator is present between said casing and said electrically conductive reactive mass.

10. The shaped charge of claim 3 wherein an insulator is present between said casing and said electrically conductive reactive mass.

11. A process for perforating an object comprising the steps of:

a) providing a shaped charge, said shaped charge comprising a cable, a casing, an electrically conductive reactive mass and a liner, said cable being electrically connected to said electrically conductive reactive mass, and said reactive mass positioned between said casing and said liner, wherein said electrically conductive reactive mass comprises a distribution of conductive reactive material and an oxidizing material which will oxidize said electrically conductive reactive mass at a temperature of at least 1000° K., b) activating said electrically conductive reactive mass with a pulsed electrical charge of at least 0.5 kJ/grams of electrically conductive reactive mass in less than 20 microseconds, c) activation of said electrically conductive reactive mass by said pulsed electrical charge causing at least some of said electrically conductive reactive mass to pass into a vapor phase and being oxidized by said oxidizing material, d) said electrically conductive reactive mass being oxidized by said oxidizing material causing liner mass to be projected from said shaped charge and perforating an object.

12. The process of claim 11 wherein said pulsed current enters a reactive mass comprising metal wire wrapped circumferentially about the liner in layers so that current can flow in series and/or parallel though said wire, each wire is covered by a sheath of insulating material that is an insulator during heating and a first oxidizing material after the metal wire passes into said vapor phase.

13. The process of claim 12 wherein said wire covered by a sheath is immersed in a second oxidizing material different from said first oxidizing material, and said second oxidizing material is between the liner and the casing.

14. A process for perforating an object comprising the steps of:

a) providing a shaped charge, said shaped charge comprising a cable, a casing, a reactive mass and a liner, said cable being electrically connected to said reactive mass, and said reactive mass positioned between said casing and said liner, wherein said reactive mass comprises a distribution of conductive reactive material and an oxidizing material which will oxidize said reactive at a temperature of at least 1000° K., b) activating said reactive mass with a pulsed electrical charge of at least 0.5 kJ/grams of reactive mass in less than 20 microseconds, c) activation of said reactive mass by said pulsed electrical charge causing at least some of said conductive reactive material to pass into a vapor phase and being oxidized by said oxidizing material, d) said conductive reactive material being oxidized by said oxidizing material causing liner mass to be projected from said shaped charge and perforating an object, wherein said pulsed current enters a reactive mass comprising metal wire wrapped circumferentially about the liner in layers so that current can flow in series and/or parallel though said wire, each wire is covered by a sheath of insulating material that is an insulator during heating and a first oxidizing material after the metal wire passes into said vapor phase wherein sufficient energy is passed to the metal wire via Joule heating to cause the wires to burst by having said metal wire vaporize, the energy of said pulsed current being rapidly deposited into the wire to cause oxidation reactions with said metal to occur in less that 2 microseconds to achieve pressures of greater than 75 kilobars, causing the liner to collapse, and forming a jet of rapidly moving material which perforates said object.

15. The process of claim 14 wherein said oxidation reactions occur between both the wire and its insulator and the wire and said second oxidizing material.

16. A process for perforating an object comprising the steps of:

a) providing a shaped charge, said shaped charge comprising a cable, a casing, a reactive mass and a liner, said cable being electrically connected to said reactive mass, and said reactive mass positioned between said casing and said liner, wherein said reactive mass comprises a distribution of conductive reactive material and an oxidizing material which will oxidize said reactive at a temperature of at least 1000° K., b) activating said reactive mass with a pulsed electrical charge of at least 0.5 kJ/grams of reactive mass in less than 20 microseconds, c) activation of said reactive mass by said pulsed electrical charge causing at least some of said conductive reactive material to pass into a vapor phase and being oxidized by said oxidizing material, d) said conductive reactive material being oxidized by said oxidizing material causing liner mass to be projected from said shaped charge and perforating an object, wherein said pulsed current enters a reactive mass comprising metal wire wrapped circumferentially about the liner in layers so that current can flow in series and/or parallel though said wire, each wire is covered by a sheath of insulating material that is an insulator during heating and a first oxidizing material after the metal wire passes into said vapor phase wherein 60% to 70% of the energy in said pulsed charge is deposited into the wire during the latter 25% of the time internal of said pulse.

17. The process of claim 12 wherein as the oxidation reactions reach completion, at least 90% by weight of the conductive metal wire in an original path for said pulsed current will have been transformed into oxides of low conductivity.

18. The process of claim 17 wherein said transformation of metal wire causes the original path of the current to become highly resistive, leading to a large inductive voltage transient, with the original current path beginning to act like an opening switch, allowing the commutation of any remaining current to flow along a rear portion of the liner, leading to additional collapsing forces on the rear of the liner.

19. The process of claim 18 wherein said remaining current passing though a rear portion of said liner causes magnetic pressure within said casing to increase as the liner approaches the axis.

20. A process for perforating an object comprising the steps of:

a) providing a shaped charge, said shaped charge comprising a cable, a casing, an electrically conductive reactive mass and a liner, said cable being electrically connected to said electrically conductive reactive mass, and said electrically conductive reactive mass positioned between said casing and said liner, wherein said electrically conductive reactive mass comprises a distribution of aluminum metal and an oxidizing material which will oxidize said aluminum metal at a temperature of at least 1000° K., b) activating said electrically conductive reactive mass with a pulsed electrical charge of at least 1 kJ/gram of aluminum in less than 20 microseconds, c) activation of said conductive reactive mass by said pulsed electrical charge causing at least some of said aluminum metal to pass into a vapor phase and being oxidized by said oxidizing material, said aluminum being oxidized by said oxidizing material causing liner mass to be projected from said shaped charge and perforating an object.

21. An explosive device comprising:

a) a casing, b) an electrical connection means though said casing to a reactive mass within said casing, c) said reactive mass consisting essentially of an electrically conductive reactant in association with an oxidizing agent, d) said conductive reactant forming an electrically conductive path along its entire length.

22. The explosive device of claim 21 in which a generator capable of providing pulsed electrical charges of at least 1 kJ/gram/50 microseconds of conductive reactant in said casing is electrically connected to said electrical connection means, and said reactive mass comprises a metal selected from the group consisting of aluminum, zirconium, beryllium, titanium, lithium, magnesium, manganese, iron silver, zinc, boron, silicon and copper.

* * * * *